US007422501B2

(12) United States Patent
Mizushima et al.

(10) Patent No.: US 7,422,501 B2
(45) Date of Patent: Sep. 9, 2008

(54) THROTTLE VALVE OPENING CONTROL DEVICE FOR A WATERCRAFT ENGINE

(75) Inventors: Yoshihiro Mizushima, Shizuoka (JP); Shu Akuzawa, Shizuoka (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/240,689

(22) Filed: Sep. 30, 2005

(65) Prior Publication Data

US 2006/0154537 A1 Jul. 13, 2006

Related U.S. Application Data

(63) Continuation of application No. PCT/JP2005/000175, filed on Jan. 11, 2005.

(51) Int. Cl.

| | |
|---|---|
| ***B63H 21/21*** | (2006.01) |
| ***B63B 35/73*** | (2006.01) |
| ***F02D 9/08*** | (2006.01) |
| ***F02D 11/10*** | (2006.01) |

(52) U.S. Cl. ..... 440/84; 440/87

(58) Field of Classification Search ..... 440/1, 440/84, 87; 701/21

See application file for complete search history.

(56) References Cited

U.S. PATENT DOCUMENTS 5,318,466 A * 6/1994 Nagafusa ..... 440/86
6,536,409 B1 * 3/2003 Takahashi et al. ..... 123/336
7,166,003 B2 * 1/2007 Motose ..... 440/1
2005/0085141 A1 * 4/2005 Motose ..... 440/87

FOREIGN PATENT DOCUMENTS

| | | |
|---|---|---|
| JP | 07-133733 | 5/1995 |
| JP | 2001-107752 | 4/2001 |
| JP | 2004-036574 | 2/2004 |
| JP | 2004-286018 | 10/2004 |

OTHER PUBLICATIONS

Search Report for PCT/JP2005/000175, mailed Mar. 1, 2005.

* cited by examiner

*Primary Examiner*—Ajay Vasudeva
(74) *Attorney, Agent, or Firm*—Knobbe, Martens, Olson & Bear, LLP

(57) ABSTRACT

A throttle valve opening control device for a watercraft engine includes a control section for controlling a valve drive section that drives the throttle valve based upon a signal from a remote controller operating position detecting means. The control section determines whether the operating position is in a trolling range or in a propelling range by the signal from the remote controller operating position detecting means. When the control section determines that the operating position is in the trolling range, the control section adjusts the throttle valve opening by an amount, relative to an operational amount of the remote controller, smaller than when the operating position is in the propelling range.

15 Claims, 9 Drawing Sheets

THROTTLE VALVE OPENING CONTROL DEVICE FOR A WATERCRAFT ENGINE

CROSS-REFERENCE TO RELATED APPLICATIONS

This application is a continuation of PCT Application No. PCT/JP2005/000175, which was filed on Jan. 11, 2005, the entire contents of which are incorporated herein by reference and should be considered a part of this specification.

BACKGROUND OF THE INVENTION

1. Field of the Invention

This invention relates to an engine speed control device for a watercraft engine, and in particular to a throttle valve opening control device that controls engine operation to be more sensitive to acceleration when operating in a propulsion condition and less sensitive to acceleration when operating in a trolling condition.

2. Description of the Related Art

In general, with regard to watercrafts, a user who wants to enjoy fishing is apt to run a watercraft in a high speed operation toward a fishing ground and also to move in a trolling operation (low speed operation) in the fishing ground. Particularly, adjusting a speed for setting bait adrift is one of the most important factors to get a target fish in the trolling operation. Thus, fine speed adjustment is desired at a low speed. When the watercraft transfers to the propulsion condition from the trolling condition, improvement of responsiveness in the watercraft operation is desired so that the watercraft rapidly changes to the high speed condition from the low speed condition.

In conventional watercraft engines, an operator control is used to accelerate the watercraft engine. The movement of the operator control mechanically moves a throttle valve via a cam, such that the throttle valve is adjusted in a non-linear manner relative to the movement of the operator control. However, the mechanical structure in conventional engine speed control devices makes it difficult to provide reduced sensitivity to acceleration when operating the watercraft in a trolling condition, while also providing increased responsiveness to acceleration when operating the watercraft in a propelling condition.

In contrast, electrically operated throttling devices that provide for variable throttle valve operation based on the position of an accelerator control are available in four-wheeled vehicles. One such device is disclosed, for example, in Japanese Patent Application No. JP 2004-036574.

However, known technology for throttling devices in four-wheeled vehicles does not adequately provide the engine speed control desired in watercraft operation. For example, in watercraft, a trolling operation is desirable, where the engine speed sometimes operates at or below an idle speed of the engine. It is difficult to use a four-wheeled throttling technology to provide reduced sensitivity to acceleration in a watercraft when operating in the trolling condition, while also providing increased sensitivity or responsiveness to acceleration when operating in a propulsion condition. Accordingly, there is a need for an improved engine speed control device for watercraft.

SUMMARY OF THE INVENTION

One aspect of the present invention involves a control system which provides different sensitivities for the movement of a controller depending on which operational mode the watercraft is operating in. For example, the control system provides less sensitivity to acceleration when the watercraft operates in a trolling condition, and also provides more sensitivity or increased responsiveness to acceleration when the watercraft operates in a propulsion condition.

Another aspect of the present invention involves a throttle valve opening control device for a watercraft engine, in which at least one throttle valve opening of the engine is controlled by an operation of a remote controller. The control device comprises a remote controller operating position detecting means for detecting an operating position of the remote controller, and a control section for controlling a valve drive section that drives at least one throttle valve based upon a signal from the remote controller operating position detecting means. The control section determines whether the operating position is in a trolling range or in a propelling range by the signal from the remote controller operating position detecting means, and when the control section determines that the operating position is in the trolling range, the control section makes a change amount of the throttle valve opening, relative to an operational amount of the remote controller, smaller than the change amount at a moment when the control section determines that the operating position is in the propelling range.

Another aspect of the present invention involves a control device for a watercraft engine, in which the engine is controlled by an operation of a remote controller. The control device comprises at least one accelerator position sensor adapted to detect an operating position of the remote controller. The control device also comprises a controller adapted to control an engine speed control device based upon a signal from the at least one accelerator position sensor, the controller configured to determine whether the operating position of the remote controller is in a trolling range or in a propelling range of the watercraft engine based on the signal from the at least one accelerator position sensor. The controller adjusts the operation of the engine speed control device, relative to an operational amount of the remote controller, by an amount that is smaller when the operating position is in the trolling range than the amount when the operating position is in the propelling range.

Still another aspect of the present invention involves a throttle valve opening control device for a watercraft engine, in which at least one throttle valve opening of the engine is controlled by an operation of a remote controller. The control device comprises at least one accelerator position sensor adapted to detect an operating position of the remote controller and means for adjusting the at least one throttle valve opening based upon a signal from the at least one accelerator position sensor, wherein the throttle valve is adjusted by an amount that is smaller when the operating position of the watercraft engine is in a trolling range than when it is in a propelling range.

In yet another aspect of the present invention, a method for controlling a throttle valve position for a watercraft engine. The method comprises sensing an operating position of a remote controller and adjusting the position of at least one throttle valve based on the sensed position signal by an amount that is smaller when the operating position is in a trolling range than when the operating position is in a propelling range.

BRIEF DESCRIPTION OF THE DRAWINGS

These and other features, aspects and advantages of the present invention will now be described in connection with a preferred embodiment of the invention, in reference to the accompanying drawings. The illustrated embodiment, however, is merely an example and is not intended to limit the invention. The drawings include the following eight figures.

DETAILED DESCRIPTION OF THE PREFERRED EMBODIMENT

Figure 1:
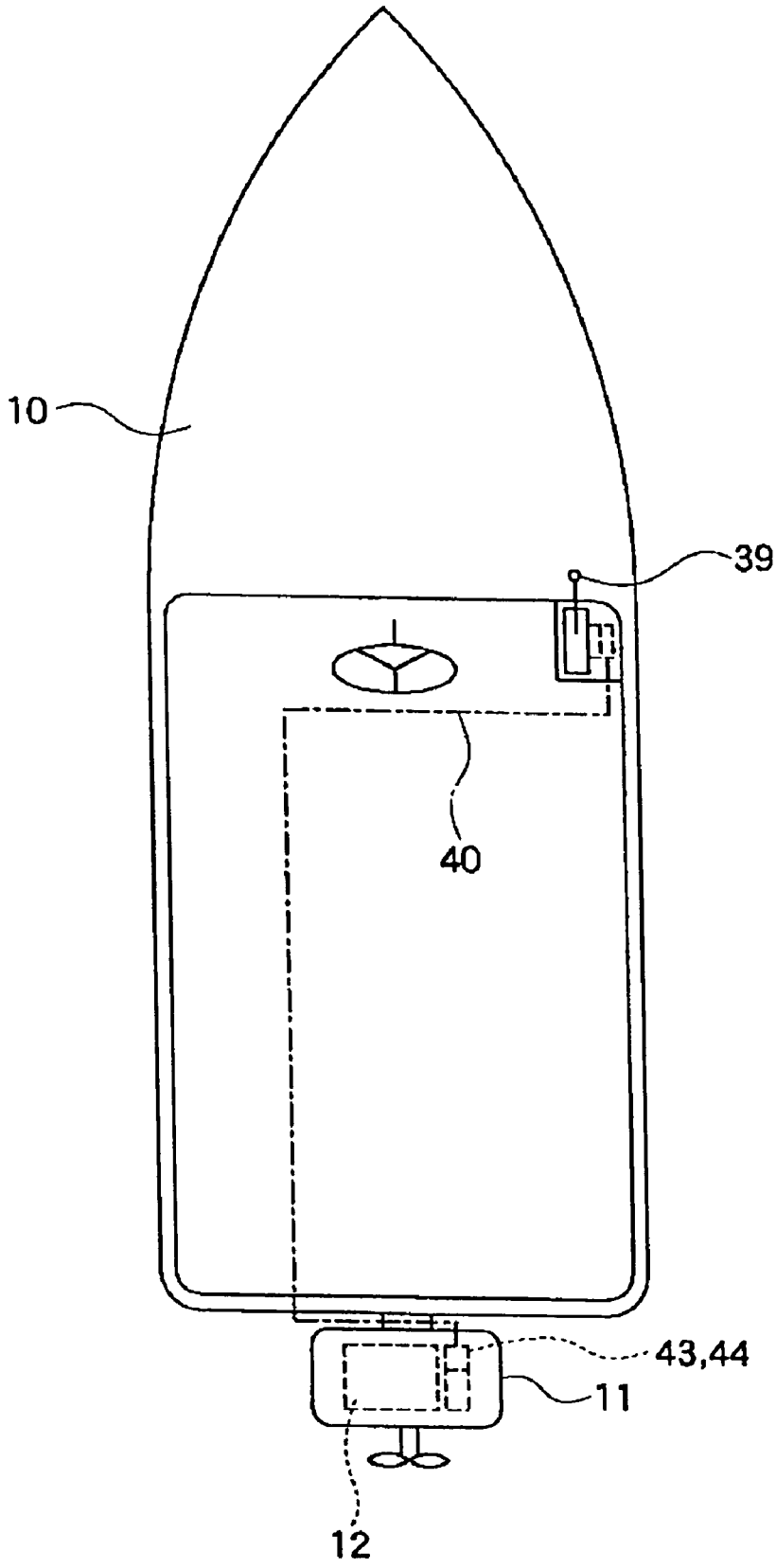
FIG. 1 is a schematic top plan view of a hull according to one embodiment.

With reference to FIG. 1, a hull 10 has an outboard motor 11 mounted on a transom thereof. An engine 12 covered with a cowling 20 is disposed in this outboard motor 11, as shown in FIG. 2.

In the illustrated embodiment, the engine 12 has a cylinder block 13 that defines two cylinder bores 14. Inside of each cylinder bore 14, a piston 17 is movably disposed, the piston 17 connected to a crankshaft 16 via a connecting rod 15. The piston 17 is configured to reciprocatingly move in the corresponding cylinder bore 14. A top surface of each piston 17, together with an inner surface of the corresponding cylinder bore 14 and a recessed portion of a corresponding cylinder head 18 fixed to the cylinder block 13 form a combustion chamber 19. Though the engine 12 illustrated shows a cylinder block with two cylinder bores 14 and corresponding pistons 17, the engine 12 can have any suitable number of cylinder bores 14 and pistons 17. Therefore, the following discussion regarding one cylinder bore 14, one piston 17, and one cylinder head 18 is applicable to the other cylinder bores 14, pistons 17, and cylinder heads 18.

Each cylinder head 18 has an intake port 22 and an exhaust port 23, both opening toward the combustion chamber 19. The intake port 22 and the exhaust port 23 have an intake valve 24 and an exhaust valve 25, respectively. Further, each cylinder head 18 has an ignition plug 26 positioned generally in a center of the recessed portion of the cylinder head 18.

Figure 2:
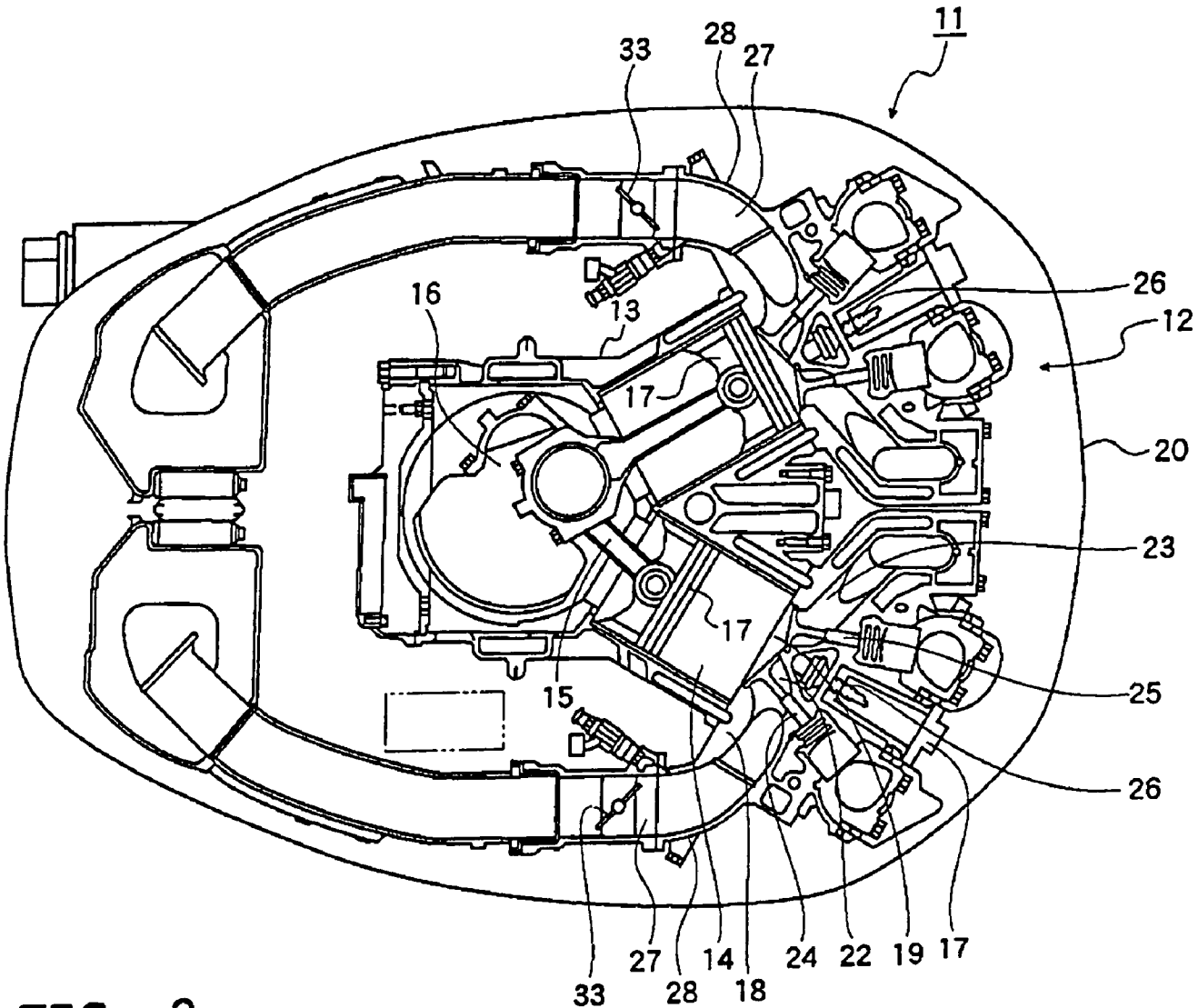
FIG. 2 is a schematic view of a watercraft engine according to one embodiment.

As shown in FIG. 2, an intake pipe 28 that defines an intake passage 27 is coupled with an upstream portion of the intake port 22 of each cylinder head 18, while an exhaust pipe (not shown) that defines an exhaust passage is coupled with a downstream portion of the exhaust port 23 of each cylinder head 18.

The engine 12 preferably includes an engine speed control device. In the illustrated embodiment, the engine speed control device includes a throttle valve. However, in other embodiments, the engine speed control device can include a fuel injector, an intake valve, and an engine ignition controller.

In the illustrated embodiment, a throttle valve 33 is disposed in each intake passage 27 to adjust an amount of intake air that passes to the combustion chamber 19. However, in another embodiment, the engine 12 can have fewer throttle valves 33 than intake passages 27. For example, one throttle valve 33 can control intake into all the cylinders 14 of the engine 12. In a preferred embodiment, the throttle valve 33 is driven (e.g., electronically controlled) by an electric motor 34 that acts as a "valve drive section." Further, two throttle position sensors 35, 36 (see FIG. 3), both of which detect an opening of this throttle valve 33 are disposed in the intake passage 27. By providing the two throttle position sensors 35, 36, if detection values from both of the sensors differ from each other, a smaller value is selected for preventing an erroneous detection from occurring and also for ensuring the proper operation of the engine 12.

In one embodiment, as shown in FIG. 1, a remote controller 39 is disposed adjacent to an operator's seat in the bow of the hull 10, and a cable 40 extends from the remote controller 39. Within the cowling 20, accelerator position sensors 43, 44 acting as "remote controller operating position detecting means" are disposed at an end of this cable 40 on a side of the engine 12 to detect an operating position of the remote controller 39 (see FIGS. 1 and 3). By providing the two accelerator position sensors 43, 44, if detection values from both of the sensors differ from each other, a smaller value is selected for preventing an erroneous detection from occurring and also for ensuring the proper operation of the engine 12.

Figure 3:
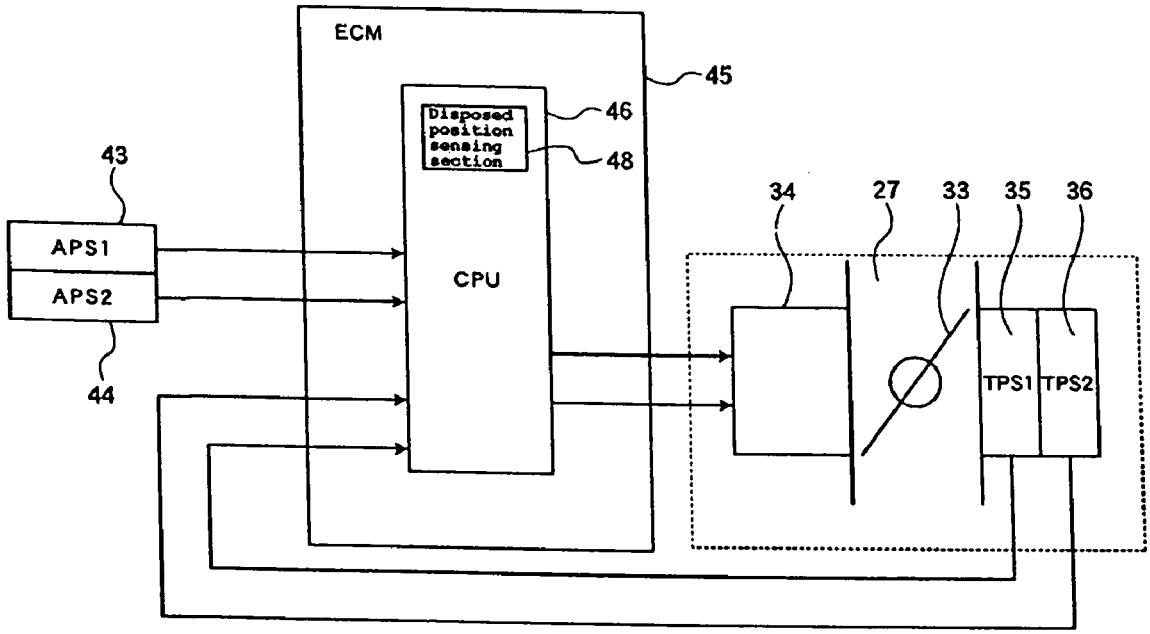
FIG. 3 is a block diagram of a throttle valve opening control device according to one embodiment.

As shown in FIG. 3, a control device 45 is constructed such that the output signal of the accelerator position sensors 43, 44 and the output signal of the throttle position sensors 35, 36 are inputted into a control section (hereunder, called as "CPU") 46 of an engine control module (hereunder, called as "ECM") that conducts various controls of the engine 12.

The CPU 46 conducts various computations for the various controls based upon the inputted signals. The device 45 is also constructed such that a signal is sent to the motor 34 from the CPU 46 to control the opening of the throttle valve 33, which will be described below, and also such that this opening of the throttle valve 33 is detected by the throttle position sensors 35, 36 and is fed back to the CPU 46.

The CPU 46 is designed to determine, based on the signals from the accelerator position sensors 43, 44, whether the operating position of the remote controller 39 is in a trolling range A or in a propelling range B. As used herein, a propelling range is one in which the watercraft is propelled well above an idle speed of the engine 12. The CPU 46 is also designed such that, when the CPU 46 determines that the operating position is in the trolling range A, the CPU 46 changes the throttle valve opening by an amount, relative to an operational amount of the remote controller 39, that is smaller than the change amount when the CPU 46 determines that the operating position is in the propelling range B.

In one preferred embodiment, the CPU 46 is designed to compute a target value of the throttle valve opening by multiplying a value of the operating position of the remote controller 39 by a characteristic conversion coefficient K, and when the operating position of the remote controller is in the trolling range A (see FIG. 8), a value of the characteristic conversion coefficient K is decided to be smaller than the value of the characteristic conversion coefficient K at a moment when the operating position is in the propelling range B. Also, if the remote controller 39 is operated more than a preset value toward a high speed rotation side from a low speed rotation side, the CPU 46 decides the preset value to be an upper limit of the detection values provided by the accelerator position sensors 43, 44.

The CPU 46 also includes a disposed position sensing section 48 for sensing whether the accelerator position sensors 43, 44 are disposed on the side of the remote controller 39 (for example, within a remote controller unit) or on the side of the engine 12 (for example, within the cowling 20 of the outboard motor 11, as shown in the embodiment illustrated in FIG. 1). The CPU 46 varies the characteristic conversion coefficient value K and the foregoing upper limit by a signal from this disposed position sensing section 48, depending on situations whether the accelerator position sensors 43, 44 are disposed on the side of the remote controller 39 or on the side of the engine 12, as further described below. In one preferred embodiment, the disposed position sensing section 48 senses a disposed position of the accelerator position sensors 43, 44 using a signal inputted from a changeover switch. Alternatively, the disposed position sensing section 48 can determine that the accelerator position sensors 43, 44 are disposed on the side of the remote controller 39, when an operating position signal is inputted through LAN communication from the remote controller 39, and in other occasions, the disposed position sensing section 48 can determine that the accelerator position sensors 43, 44 are disposed on the side of the engine 12. While the remote controller 39 and the accelerator position sensors 43, 44 are preferably hardwired together, in other applications the components can communicate via a wireless network (e.g., employ IR communication).

Figure 4:
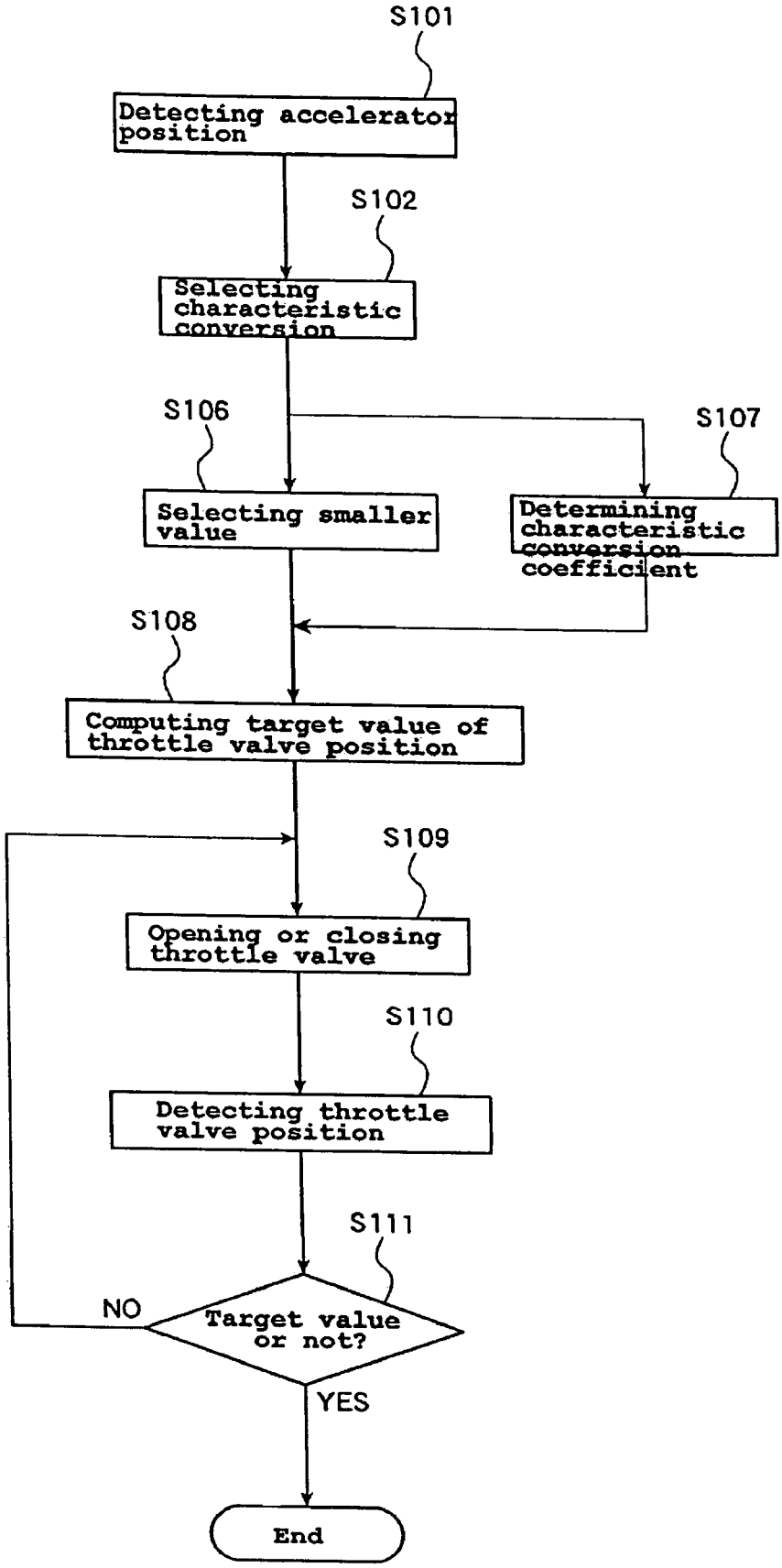
FIG. 4 is a flowchart used for opening or closing a throttle valve according to one embodiment.

With respect to FIG. 4, upon operation of the remote controller 39, the cable 40 is moved, and the operating position of the remote controller 39 is detected by the two accelerator position sensors 43, 44 (step S101). A signal of this operating position is inputted into the CPU 46, as shown in FIG. 3. If detection values of the operating position by the two accelerator position sensors 43, 44 are the same as each other, the operating position is detected by the detection value, while, if detection values differ from each other, the operating position is detected by the smaller value provided by the accelerator position sensors 43, 44.

Then, at a step S102, a selection of a characteristic conversion is conducted in accordance with the difference between the attached positions of the accelerator position sensors 43, 44.

Figure 5:
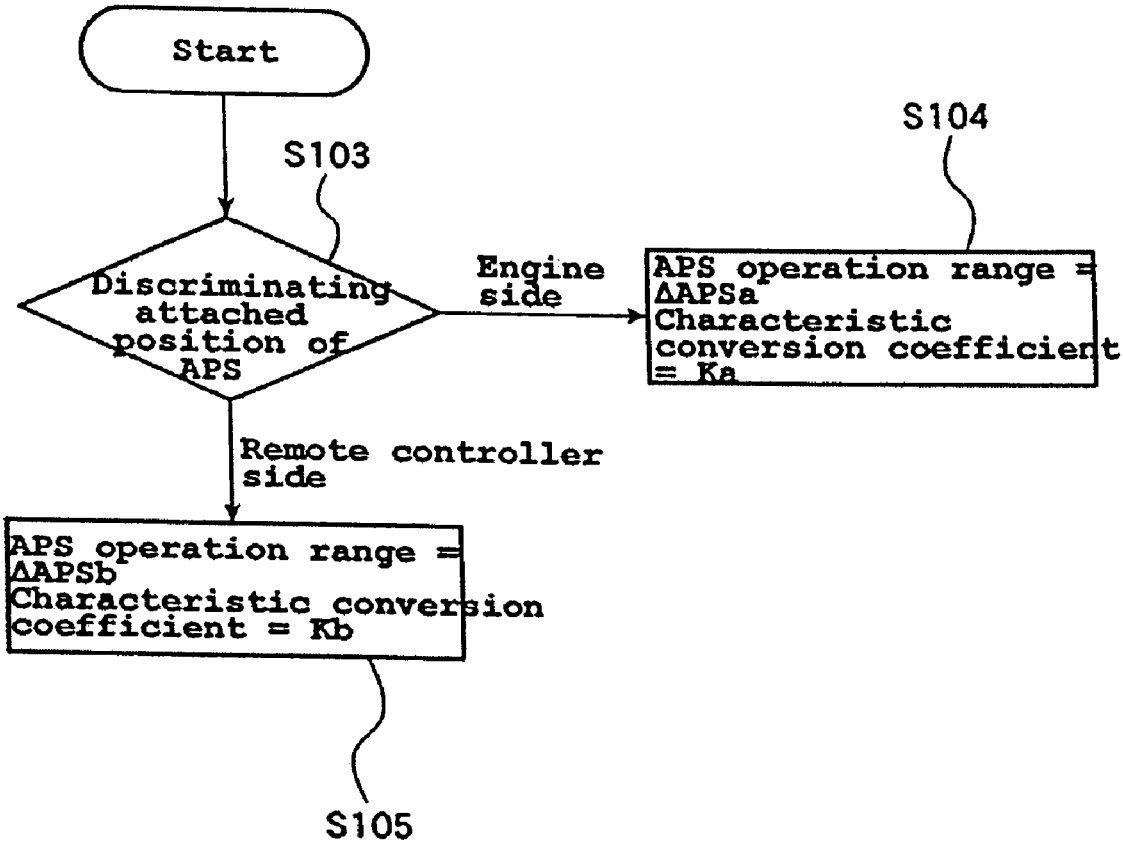
FIG. 5 is a flowchart used for conducting a selection of a characteristic conversion according to one embodiment.

In one embodiment shown in FIG. 5, for this characteristic conversion selection, the disposed position sensing section 48 discriminates (step S103) the attached positions of the accelerator position sensors 43, 44 from each other. In this discrimination, upon an operation of the changeover switch, if a signal that indicates the accelerator position sensors 43, 44 are attached to the side of the engine 12 is sent, the CPU 46 proceeds with a step S104, while, if a signal that indicates the accelerator position sensors 43, 44 are attached to the side of the remote controller 39 is sent, the CPU 46 proceeds with a step S105. In another embodiment, the disposed position sensing section 48 can determine that the accelerator position sensors 43, 44 are disposed on the side of the remote controller 39 by the LAN communication from the remote controller 39, and the CPU 46 can go to the step S105. In other occasions, the disposed position sensing section 48 can determine that the accelerator position sensors 43, 44 are disposed on the side of the engine 12, and the CPU 46 can go to the step S104.

Figure 6:
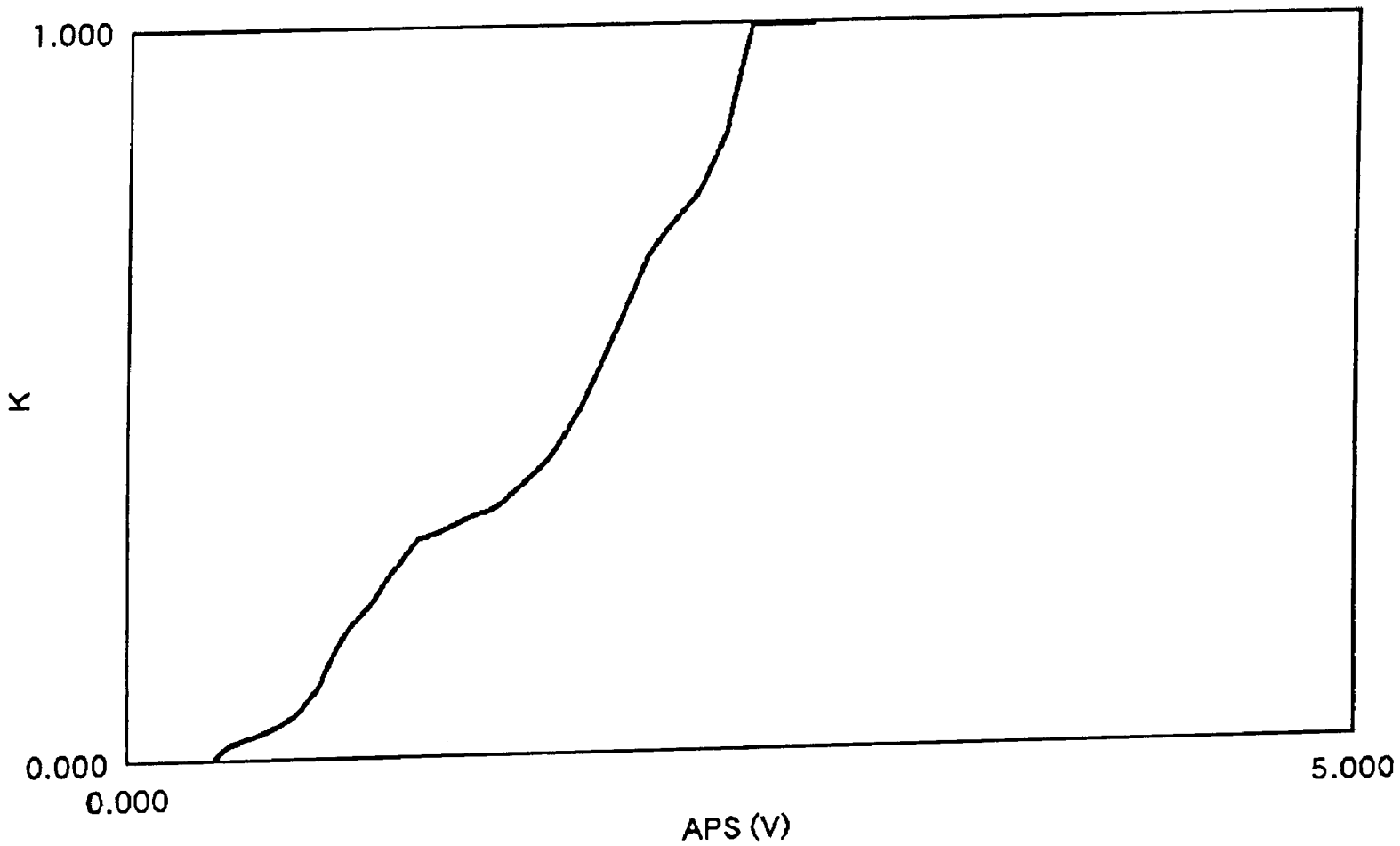
FIG. 6 is a graph indicating a characteristic conversion coefficient used in a situation where an accelerator position sensor is attached onto a side of the engine, in accordance with one embodiment

At the step S104, in consideration of play of the cable 40 and so forth, an APS operation range (upper limit of the detection value) is set to ΔAPSa, and a characteristic conversion coefficient Ka is set to the characteristic shown in FIG. 6.

Figure 7:
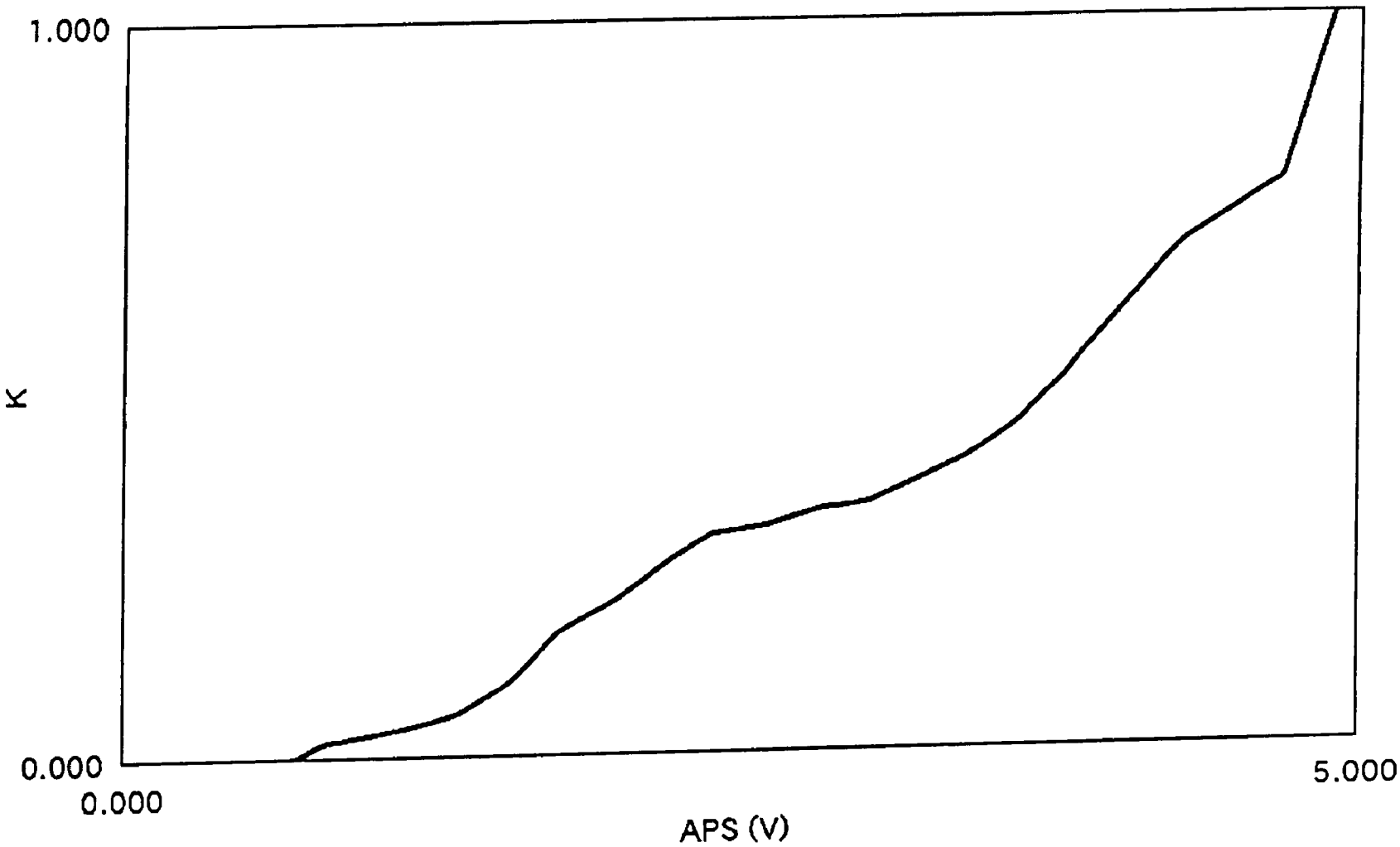
FIG. 7 is a graph indicating a characteristic conversion coefficient used in another situation where the accelerator position sensor is attached onto a side of a remote controller, in accordance with another embodiment.

Also, at the step S105, hardly with taking the play of the cable and so forth into consideration, the APS operation range (upper limit of the detection value) is set to ΔAPSb, and the characteristic conversion coefficient Kb is set to the characteristic shown in FIG. 7. This ΔAPSb is set greater than the ΔAPSa. Under this condition, the characteristic conversion selection is conducted.

In the embodiment illustrated in FIG. 1, because the accelerator position sensors 43, 44 are disposed on the side of the engine 12 in this embodiment, the CPU 46 proceeds with the step S104 to conduct the characteristic conversion selection described above.

Next, at a step S106 in FIG. 4, the detection value of the remote controller 39 that has been detected and the upper limit selected at the step S102 are compared with each other, and a smaller value of them is selected. Accordingly, the remote controller 39 is operated toward the high speed rotation side from the low speed rotation side. The embodiment is designed such that the throttle valve 33 inevitably reaches the fully open position under a condition that the remote controller 39 reaches its operation limit. In other words, the upper limit is decided to bring in this result.

On the other hand, at a step S107, the CPU 46 determines whether the operating position is in the trolling range or in the propelling range by the value of the operating position of the remote controller 39 that has been detected. When the operating position of the remote controller is in the trolling range, the value of the characteristic conversion coefficient K is decided to be smaller than a value thereof at a moment when the operating position is in the propelling range.

Next, at a step S108, the CPU 46 computes a target value of the throttle position (throttle valve opening target value) by multiplying the operating position value of the remote controller 39 by the characteristic conversion coefficient K determined at the step S107.

Also, at a step S109, a drive current is outputted to the motor 34 such that the throttle position reaches the target value, and the throttle valve 33 is driven by a certain amount to be opened or closed. At a step S110, the throttle position sensors 35, 36 detect the opening of the throttle valve 33. This detection value is fed back to the CPU 46, and, at a step S111, the CPU 46 determines whether the detection value is equal to the target value or not. If it is equal to the target value, the control program ends, while, if it is not equal to the target value, the process returns to the step S109. Therefore, when the CPU 46 determines that the operating position of the remote controller 39 is in the trolling range, the change amount of the opening of the throttle valve 33, relative to the operational amount of the remote controller 39, is smaller than the change amount when the CPU 46 determines that the operating position is in the propelling range.

Figure 8:
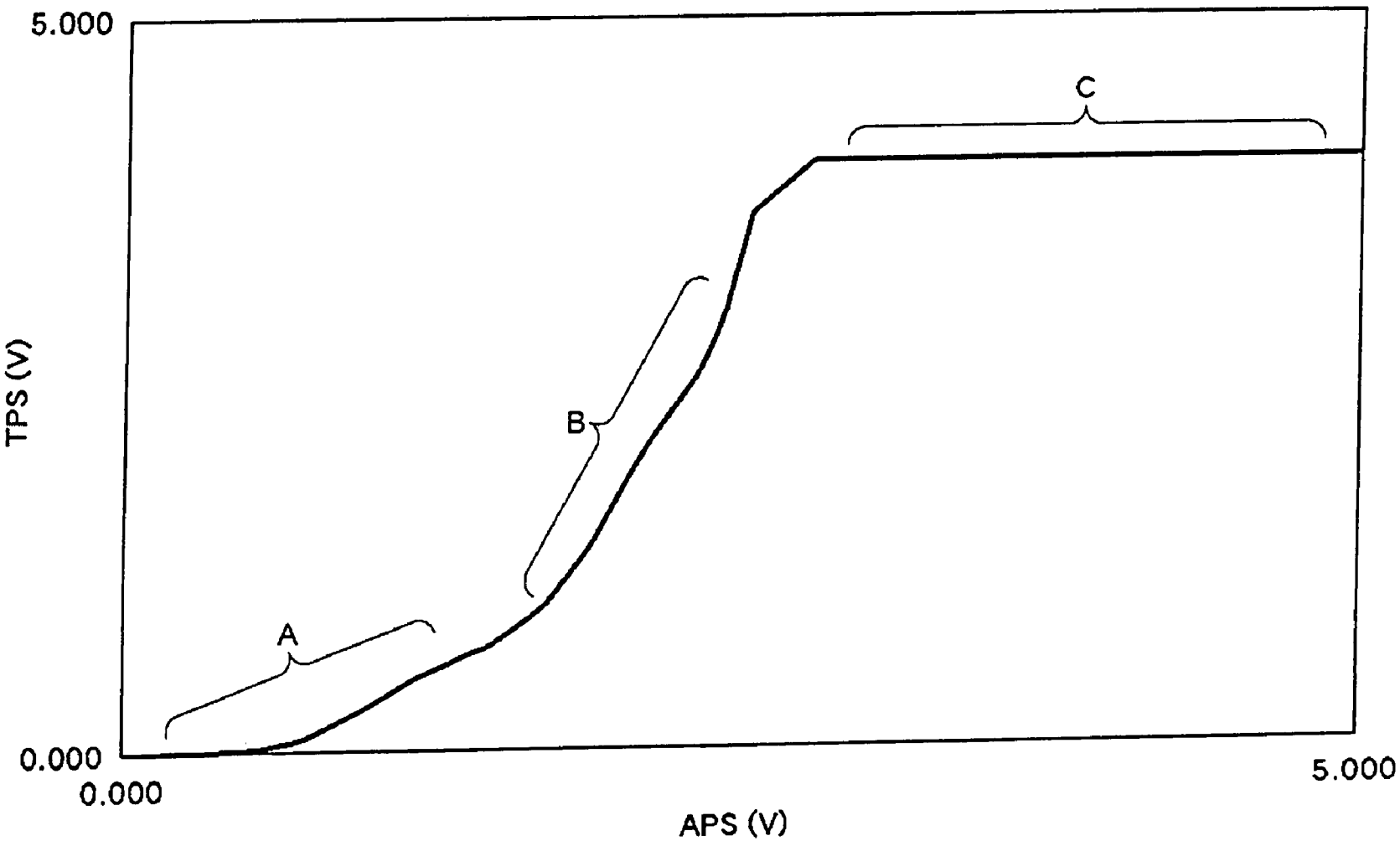
FIG. 8 is a graph indicating a throttle valve opening characteristic used in the situation where the accelerator position sensor is attached onto the side of the engine.

As shown in FIG. 8, the characteristic gently rises and the acceleration sensitivity is reduced in the trolling range A (low speed range). Thus, a fine adjustment of the speed at a low speed can be done. The characteristic quickly rises and the acceleration sensitivity is responsive in the propelling range B. The watercraft thus rapidly changes to the high speed condition from the low speed condition. Therefore, the responsiveness in the watercraft operation is improved. Further, when the operator moves the remote controller 39 midway in its movable range, i.e., when the operator moves the remote controller 39 over a preset amount, the throttle valve 33 inevitably reaches the fully open position (planing range C) because of the upper limit that is set at the step S104. Accordingly, the throttle valve 33 certainly can reach the fully open position, even if the cable 40 is long enough to make its backlash large.

In addition, the disposed position sensing section 48 advantageously allows such a control device 45 to be used with either a structure which includes the cable 40 and has the accelerator position sensors 43, 44 positioned on the side of the engine 12 or another structure which does not include the cable 40 and has the accelerator position sensors 43, 44 positioned on the side of the remote controller 39.

Further, as shown in the embodiment in FIG. 1, the device 45 is constructed such that the cable 40 extends from the remote controller 39 and the accelerator position sensors 43, 44 detect the movement of this cable 40. Thus, an existing remote controller 39 for a watercraft which has no electromagnetically operated throttle device, an existing cable 40, etc. can be used.

Figure 9:
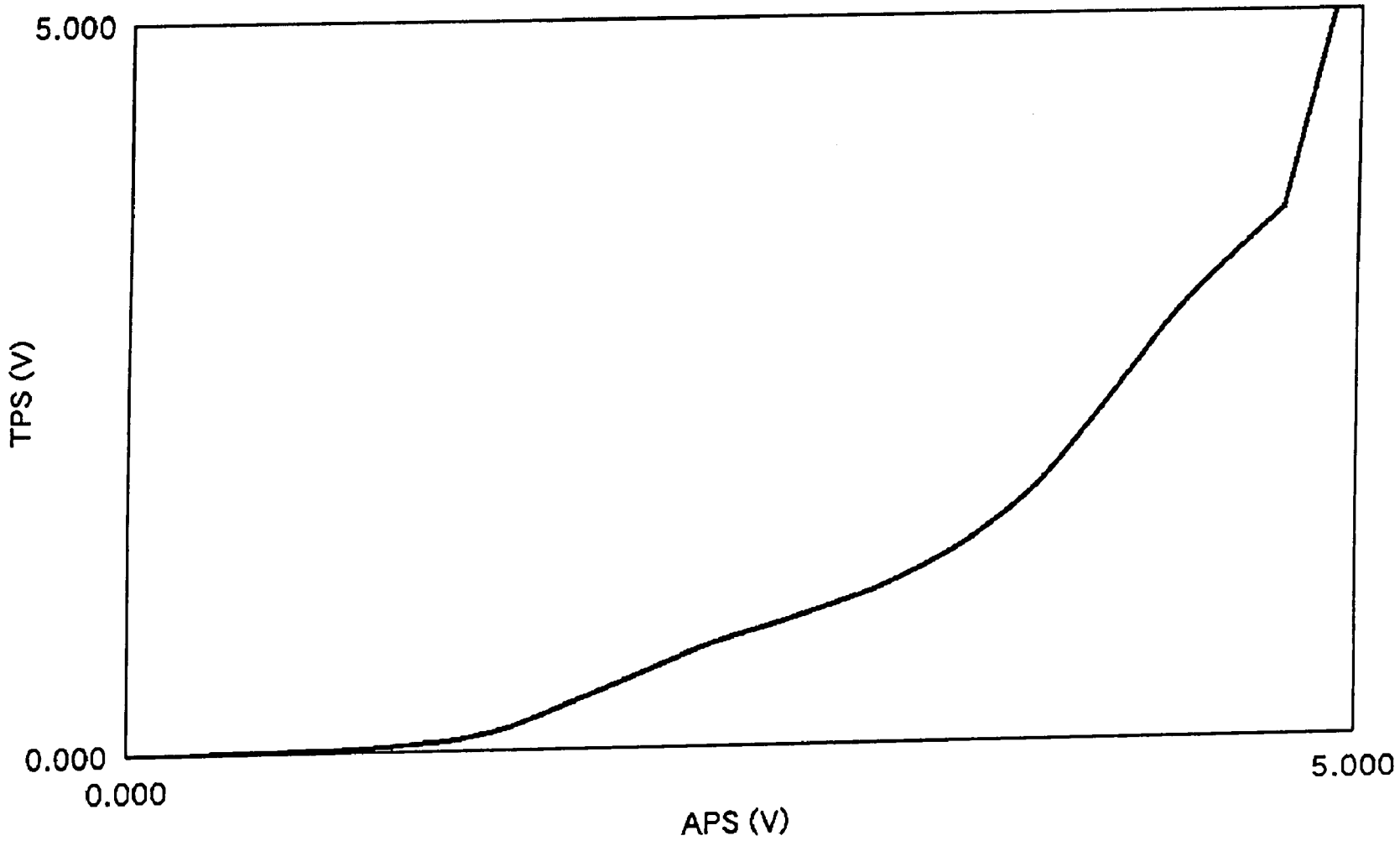
FIG. 9 is a graph indicating the throttle valve opening characteristic used in the situation where the accelerator position sensor is attached onto the side of the remote controller.

With respect to FIG. 9, in another embodiment the cable 40 is not provided and the accelerator position sensors 43, 44 are disposed on the side of the remote controller 39. In this connection, the CPU 46 proceeds with the step S105 in FIG. 5 to select the APS operation range ΔAPSb (the upper limit of the detection value) and the characteristic conversion coefficient K of FIG. 7. Therefore, the throttle valve 33 is regulated relative to the operation of the remote controller as shown in FIG. 9. In this regard, the APS operation range ΔAPSb (the upper limit of the detection value) can be larger than that shown in the embodiment illustrated in FIG. 8, because no backlash needs to be considered. The throttle valve 33 thus can be controlled generally over the entire scope in the movable range of the remote controller. The operability is improved, accordingly.

Although this invention has been disclosed in the context of a certain preferred embodiment and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Further, by listing method steps in a particular order within a claim, no intention is made to limit the scope of the claim to that particular order. Thus, it is intended that the scope of the present invention herein disclosed should not be limited by the particular disclosed embodiments described above, but should be determined only by a fair reading of the claims that follow.

What is claimed is:

1. A throttle valve opening control device for a watercraft engine, in which at least one throttle valve opening of the engine is controlled by an operation of a remote controller, comprising:

a remote controller operating position detecting means for detecting an operating position of the remote controller; and a control section for controlling a valve drive section that drives at least one throttle valve based upon a signal from the remote controller operating position detecting means, wherein the control section determines whether the operating position is in a trolling range or in a propelling range by the signal from the remote controller operating position detecting means, and when the control section determines that the operating position is in the trolling range, the control section configured to adjust the throttle valve opening by a change amount, relative to an operational amount of the remote controller, smaller than the change amount at a moment when the control section determines that the operating position is in the propelling range, the control section computing a target value of the throttle valve opening by multiplying a value of the operating position of the remote controller by a characteristic conversion coefficient, and when the operating position of the remote controller is in the trolling range, the value of the characteristic conversion coefficient is smaller than the value of the characteristic conversion coefficient at a moment when the operating position is in the propelling range.

2. The throttle valve opening control device for a watercraft engine recited in claim 1, wherein a cable extends toward the engine from the remote controller, and the remote controller operating position detecting means is disposed at an end of the cable and positioned on a side of the engine.

3. The throttle valve opening control device for a watercraft engine recited in claim 1, wherein the remote controller operating position detecting means are positioned on a side of the remote controller.

4. The throttle valve opening control device for a watercraft engine recited in claim 1, wherein, if the remote controller is operated more than a preset value toward a high speed rotation side from a low speed rotation side, the control section decides the preset value to be the upper limit of a detection value of the remote controller operating position detecting means.

5. The throttle valve opening control device for a watercraft engine recited in claim 4, wherein the control section includes a disposed position sensing section for sensing whether the remote controller operating position detecting means are disposed on the side of the remote controller or on the side of the engine, and the control section varies the upper limit by a signal from the disposed position sensing section, depending on situations whether the remote controller operating position detecting means are disposed on the side of the remote controller or on the side of the engine.

6. The throttle valve opening control device for a watercraft engine recited in claim 5, wherein the disposed position detecting section is capable of sensing a disposed position of the remote controller operating position detecting means using a signal inputted from a changeover switch.

7. The throttle valve opening control device for a watercraft engine recited in claim 5, wherein the disposed position sensing section determines that the remote controller operating position detecting means are disposed on the side of the remote controller, when an operating position signal is inputted through LAN communication from the remote controller, and in other occasions, the disposed position sensing section determines that the remote controller operating position detecting means are disposed on the side of the engine.

8. The throttle valve opening control device for a watercraft engine recited in claim 1, wherein the control section includes a disposed position sensing section for sensing whether the remote controller operating position detecting means are disposed on the side of the remote controller or on the side of the engine, and the control section varies the value of the characteristic conversion coefficient by a signal from the disposed position sensing section, depending on situations whether the remote controller operating position detecting means are disposed on the side of the remote controller or on the side of the engine.

9. A control device for a watercraft engine, in which the engine is controlled by an operation of a remote controller, comprising:

at least one accelerator position sensor adapted to detect an operating position of the remote controller; and a controller adapted to control an engine speed control device based upon a signal from the at least one accelerator position sensor, the engine speed control device being a throttle valve opening control device that controls at least one throttle valve opening, the controller configured to determine whether the operating position of the remote controller is in a trolling range or in a propelling range of the watercraft engine based on the signal from the at least one accelerator position sensor, wherein the controller adjusts the operation of the engine speed control device, relative to an operational amount of the remote controller, by an amount that is smaller when the operating position is in the trolling range than the amount when the operating position is in the propelling range, the controller computing a target value of the at least one throttle valve opening by multiplying a value corresponding to the operating position of the remote controller by a characteristic conversion coefficient.

10. The control device of claim 9, wherein the value of the characteristic conversion coefficient is smaller when the operating position of the remote controller is in the trolling range than when the operating position is in the propelling range.

11. A throttle valve opening control device for a watercraft engine, in which at least one throttle valve opening of the engine is controlled by an operation of a remote controller, comprising:

at least one accelerator position sensor adapted to detect an operating position of the remote controller; and means for adjusting at least one throttle valve opening based upon a signal from the at least one accelerator position sensor, wherein the at least one throttle valve opening is adjusted by an amount that is smaller when the operating position of the watercraft engine is in a trolling range than when it is in a propelling range, a controller configured to determine whether the operating position of the remote controller is in a trolling range or in a propelling range based on the signal from the accelerator position sensor, a target value of the throttle valve opening adjustment obtained by multiplying a value corresponding to the operating position of the remote controller by a characteristic conversion coefficient.

12. The throttle valve opening control device for a watercraft engine recited in claim 11, wherein the value of the characteristic conversion coefficient is smaller when the operating position of the remote controller is in the trolling range than when the operating position is in the propelling range.

13. A throttle valve opening control device for a watercraft engine, in which at least one throttle valve opening of the engine is controlled by an operation of a remote controller, comprising:

a remote controller operating position sensor configured to detect an operating position of the remote controller; and a controller configured to receive a signal from the remote controller operating position sensor, the controller configured to control the position of at least one throttle valve based upon said signal, the controller configured to determine whether the operating position of the remote controller is in a trolling range or in a propelling range based on the signal from the remote controller operating position sensor, to compute a target throttle position based on a characteristic conversion coefficient that varies if the operating position is in a trolling range or in a propelling range, and to adjust the throttle valve position when the operating position is in the trolling range by an amount, relative to an operational amount of the remote controller, that is smaller than the amount when the operating position is in the propelling range.

14. A control device for a watercraft engine, in which the engine is controlled by an operation of a remote controller, comprising:

at least one accelerator position sensor configured to detect an operating position of the remote controller; and a controller configured to control at least one throttle valve opening based upon a signal from the at least one accelerator position sensor, the controller configured to determine whether the operating position of the remote controller is in a trolling range or in a propelling range of the watercraft engine based on said signal, the controller configured to adjust the throttle valve opening, relative to an operational amount of the remote controller, by an amount that is smaller when the operating position is in the trolling range than the amount when the operating position is in the propelling range, the controller computing a target throttle valve opening amount based on the operating position of the remote controller and a characteristic conversion coefficient.

15. A throttle valve opening control device for a watercraft engine, in which at least one throttle valve opening of the engine is controlled by an operation of a remote controller, comprising:

at least one accelerator position sensor configured to sense an operating position of the remote controller; and means for adjusting at least one throttle valve opening based upon a signal from the at least one accelerator position sensor, the at least one throttle valve opening adjusted by an amount that is smaller when the operating position of the watercraft engine is in a trolling range than when it is in a propelling range, a controller configured to determine whether the operating position of the remote controller is in a trolling range or in a propelling range based on the signal from the accelerator position sensor, a target throttle valve opening amount determined based on a value corresponding to the operating position of the remote controller and a characteristic conversion coefficient.

* * * * *

UNITED STATES PATENT AND TRADEMARK OFFICE

CERTIFICATE OF CORRECTION

PATENT NO. : 7,422,501 B2
APPLICATION NO. : 11/240689
DATED : September 9, 2008
INVENTOR(S) : Yoshihiro Mizushima and Shu Akuzawa It is certified that error appears in the above-identified patent and that said Letters Patent is hereby corrected as shown below:

At Column 3, line 17, after “embodiment”, please insert --.--.

Signed and Sealed this

Ninth Day of June, 2009

JOHN DOLL
*Acting Director of the United States Patent and Trademark Office*